United States Patent [19]

Su

[11] Patent Number: 4,825,888

[45] Date of Patent: May 2, 1989

[54] MANUAL/AUTOMATIC DUAL-PURPOSE UMBRELLA STRUCTURE

[75] Inventor: Tseng Su, Hsin-Chu, Taiwan

[73] Assignees: Tseng, Su; Tung Ho Industry Co., Ltd., both of Taiwan

[21] Appl. No.: 142,195

[22] Filed: Jan. 11, 1988

[51] Int. Cl.[4] ..... A45B 25/16

[52] U.S. Cl. ..... 135/22; 135/24

[58] Field of Search ..... 135/22, 20, 21, 23, 135/24, 26

[56] References Cited

U.S. PATENT DOCUMENTS 3,856,030 12/1974 Sato ..... 135/22
3,906,970 9/1975 Saito et al. ..... 135/22
4,421,133 12/1983 Huang ..... 135/22
4,534,374 8/1985 Day ..... 135/22

*Primary Examiner*—J. Karl Bell
*Attorney, Agent, or Firm*—Steinberg & Raskin

[57] ABSTRACT

A manual/automatic dual-purposed umbrella structure comprising a handle, a stationary tube, an inner tube, an outer tube and a top tube. The handle has two buttons which respectively control a pushing rod and a hook portion to fix or loosen the outer tube. The inner tube and the top tube are separately passed into the outer tube from the top and the bottom thereof. The top tube and the stationary tube each respectively comprises a hook hole used for hooking a hook rod installed on the outer tube. Two springs are respectively set on the inner tube and the top tube, the elastic forces thereof forcing the umbrella frame to be opened or closed.

1 Claim, 4 Drawing Sheets

MANUAL/AUTOMATIC DUAL-PURPOSE UMBRELLA STRUCTURE

BACKGROUND OF THE INVENTION

This invention relates to a manual/automatic dual-purposed umbrella structure which is forced to be opened or closed by means of relative spring force.

A prior art structure, as shown in FIG. 4, 5, and 6, comprises two springs used for controlling an umbrella frame to open and close. FIG. 4 shows an umbrella in a closed state in which the two springs S1 and S2 are in untensed state. When desiring to open the umbrella, it is required that the user firstly press the top of the umbrella on the ground to tighten springs S1 and S2, as shown in FIG.5. In the meantime, a handle P1 combined with an umbrella tube P2 is also pressed to be near the position of the control button L1 of the umbrella frame S3. Then the button L1 is pressed, the spring force stored in springs S1 and S2 is partially released so as to open the umbrella frame S3, as shown in FIG. 6. At the opened state, springs S1 and S2 of the umbrella are in untensed state; therefore, pressing the button L2 completely looses the umbrella tube P2 and the springs S1, S2 and the umbrella frame S3 are drawn back to the original position as shown in FIG. 4.

The above-mentioned umbrella has one notable disadvantage, that it is inconvenient to use in muddy places because it is necessary to first press the umbrella tube on the ground at each opening action. Therefore, this invention provides a manual/automatic dual-purposed umbrella structure as to apply in any situations.

SUMMARY OF THE INVENTION

Accordingly, a primary object of this invention is to provide a manual/automatic dual-purposed umbrella structure which can interchange manual or automatic control at any time in accordance with the applied places and situations.

Another object of this invention is to provide a manual/automatic dual-purposed umbrella structure which comprises a top tube, a stationary tube installed respectively on the upper and lower ends of an outer tube, each of the top tube and the stationary tube having a hook-hole and a spring is set around an inner tube installed between the top tube and the stationary tube, and another spring being set between an upper sliding portion and a lower sliding portion of an umbrella frame. By means of the relationship of the spring combined the relative tubes, the umbrella in accordance with this invention is controlled to open and close.

DETAILED DESCRIPTION OF THE PREFERRED EMBODIMENT

Figure 1:
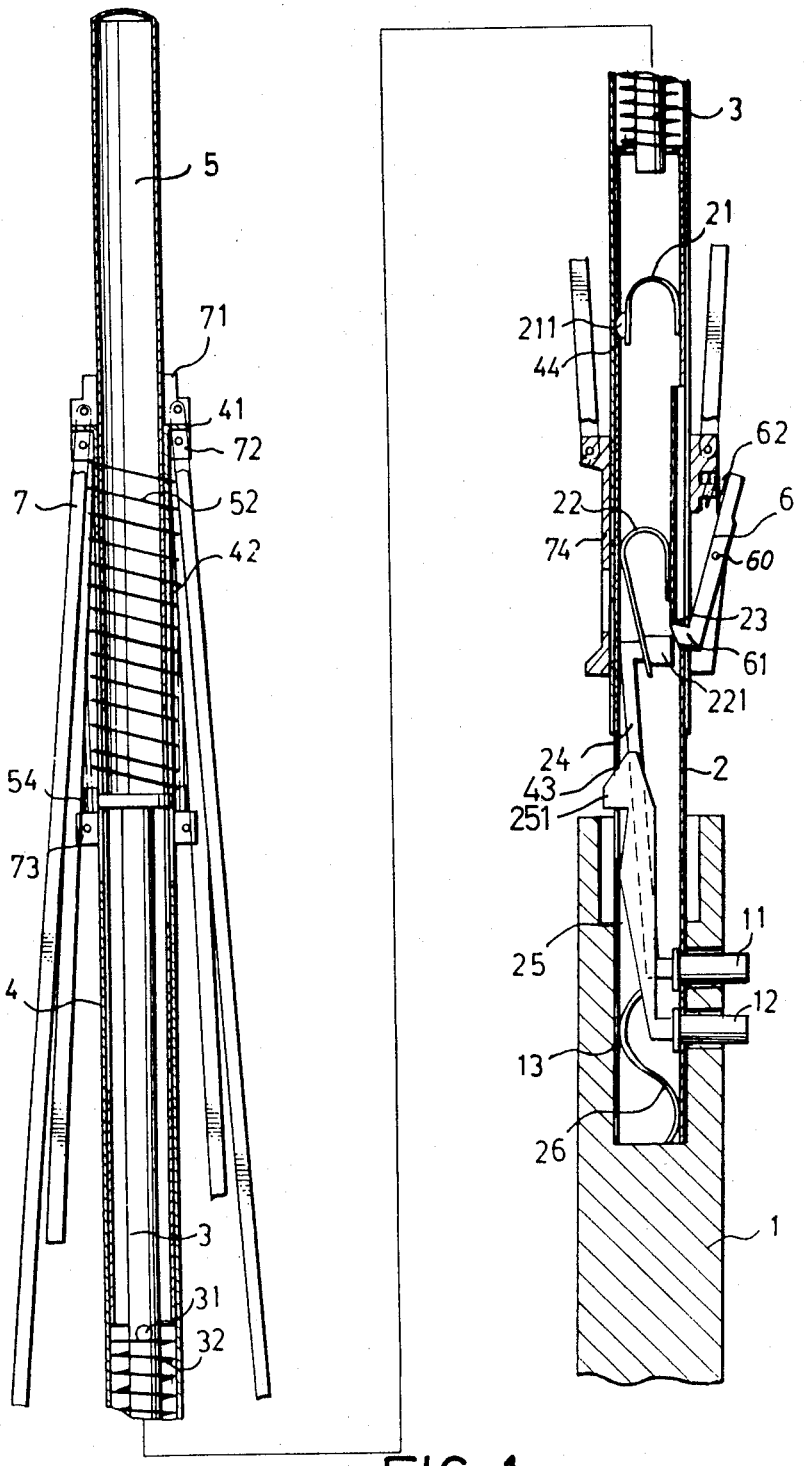
FIG. 1, 2 and 3 are sectional views of the umbrella structure of this invention respectively showing the umbrella structure in normal state, opened state and closed state.
Figure 2:
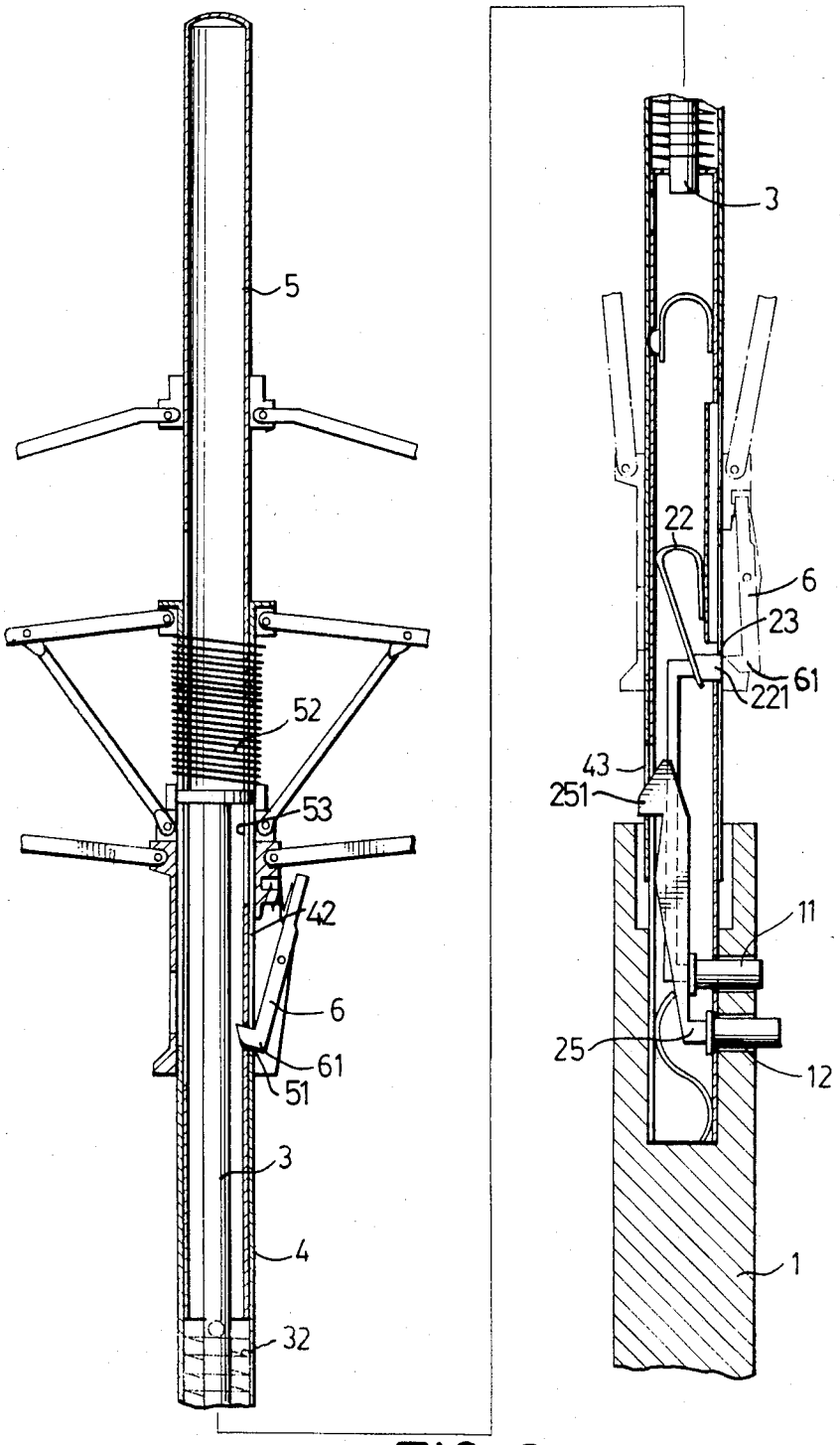
Figure 3:
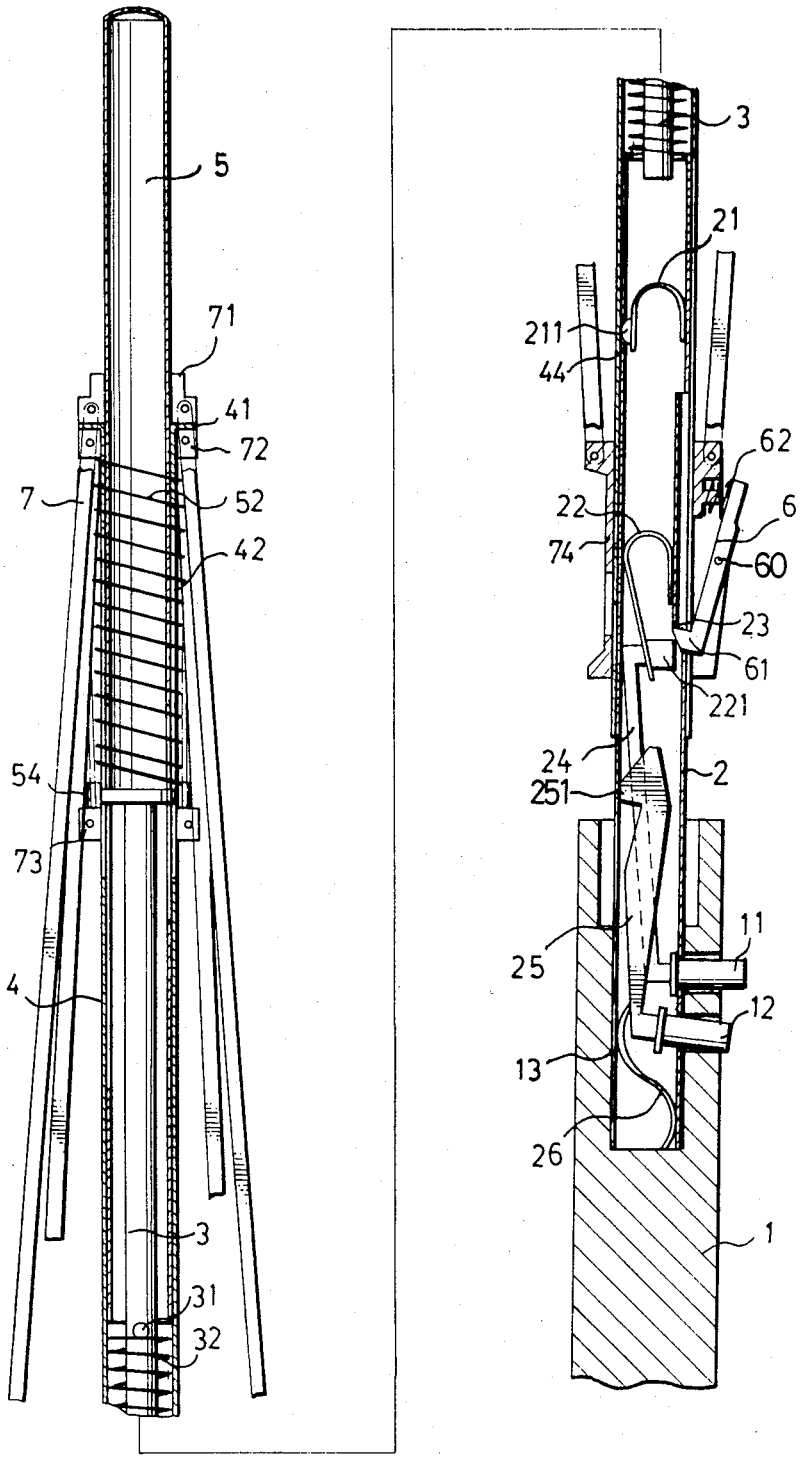
Figure 6:
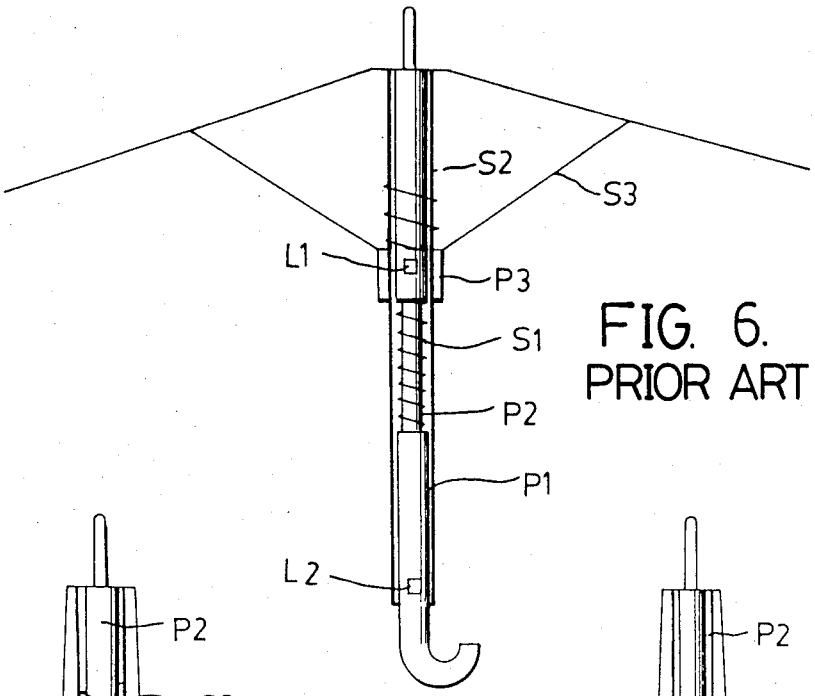
FIG. 6. PRIOR ART
FIG. 4, 5 and 6 are perspective views of a prior art structure respectively showing the umbrella in closed state, preparation state and opened state.
Figure 5:
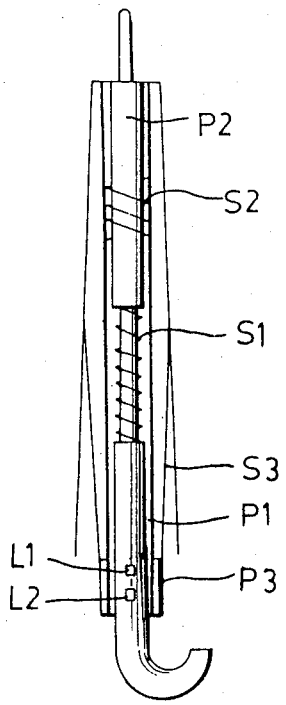
FIG. 5. PRIOR ART
Figure 4:
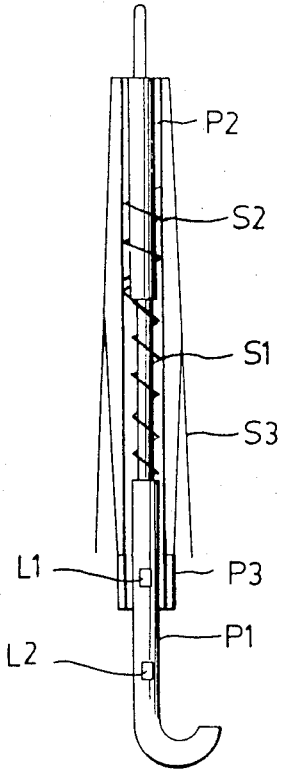
FIG. 4. PRIOR ART

Referring to FIG. 1, 2 and 3, it can be seen that a manual/automatic dual-purpose umbrella structure in accordance with this invention comprise a handle 1, a stationary tube 2, an inner tube 3, an outer tube 4 and a top tube 5. The stationary tube 2, the inner tube 3 and a part of the top tube 5 are included in the outer tube 4. The stationary tube 2 is fixed on a seat 13 of the handle 1 and comprises a pushing rod 24 and a hook rod 25. The handle has two buttons 11, 12 protruding therefrom. The pushing rod 24 and the hook rod 25 are respectively connected to the opening button 11 and the closing button 12.

Please note that a lower hook hole 23 is set on the stationary tube 2 and is used for hooking a hook 6. Hole 43 and a fixing hole 44 are set on the outer tube 4. The upper portion of the pushing rod 24 supports the pushing block 221 of a leaf spring 22 and situated in the stationary tube 2. The pushing block 221 is set at a position corresponding to that of the lower hook hole 23, so that the pushing rod 24 pushes the pushing block 221 toward the hook-hole 23 when the button 11 is pressed.

The hook rod 25 extends from the hole 43 which the lower portion is supported by another leaf spring 26 when the button 12 is in non-pressed position. It is obvious that the button 12 controls the hook portion 251 (which is also situated in the stationary tube 2) of the hook rod 25 to protrude or retract from the hole 43. Further, another leaf spring 21 is set in the upper portion of the stationary tube 2 with a protuberance 211 thereof passing through the fixing hole 44.

The inner tube 3 is installed between the stationary tube 2 and the top tube 5, and is fixed to the outer tube 4 and the top tube 5 by a pin 31. A first spring 32 is encompassed by the inner tube 3, the top of which is supported the bottom of the top tube 5. The top tube 5 partially extends from the outer tube 4. On the top of the inner tube 3, there is also set a second spring 52 encompassing the outer tube 4 and retained between the top end of the outer tube 4, which has a flange 41 thereon, and a passing pin 54. As can be seen in the figures, the passing pin 54 passes through the outer tube 4 and is supported by the top of the inner tube 3.

A plurality of umbrella ribs of the umbrella frame are separately pivoted about respective upper fixed blocks 71, lower fixed blocks 74, upper slidable blocks 72 and lower slidable blocks 73. The upper fixed blocks 71 are installed on the top tube 5. The upper slidable blocks 72, the lower slidable blocks 73 and the lower fixed blocks 74 are installed on the upper outer portion of the outer tube 4, respectively in order from the uppermost position to the lowermost position. A second spring 52 and the passing pin 54 are set between the upper and lower slidable blocks 72 and 73. The lower fixed blocks 74 are pivoted with an auxiliary rod and the lower portion thereof supports a hook rod 6 by a spring 62. The hook rod 6 is fixed on the outer tube 4 by a pin 60 and is pivotable about the pin 60. Further, an upper hook-hole 51 is set on the responding portion of the instructure of the combined outer tube 4 and the top tube 5 which cooperates with the lower hook-hole 23 mentioned above to provide a hook portion 61 of the hook rod 6 with hook effect when the outer tube 4 slides upwards or downwards. Further, the corresponding portions of the outer tube and the top tube respectively comprises a long recess 53 and a recess 42.

Accordingly, it can be seen that, in FIG. 1, the hook portion 251 projects from the hook hole 43 and the hook portion 61 of the hook rod 6 is hooked in the lower hook hole 23 when the umbrella is in the closed state. In order to provide enough elasticity for opening the umbrella, the top of the umbrella is pressed against the ground, so that the springs 32 are tightened to have large potential energy.

Now referring to FIG. 2, it can be seen that to open the umbrella, the button 11 is pressed to urge the pushing rod 24 forward and force the pushing block 221 of the leaf spring 22 to push the hook portion 61 out of the lower hook hole 23. Since the hook portion 61 is left from the lower hook hole 23 (the outer tube 4 is no longer fixed), then the potential energy of the springs 32 is converted to kinetic energy so as to force the outer tube 4 and the inner tube 3 to rise up. The hook portion 61 of the hook rod 6 is now hooked in the upper hook hole 51 which fixes the outer tube 4 and the umbrella frame in an open position. Further, it can be seen from FIG. 2, the spring 52 is pressed to be tightened by the inner tube 3.

Now referring to FIG. 3, pressing button 12 will close the umbrella. Simultaneously, the hook portion 251 of the hook rod 25 is drawn back, thereby allowing the elastic forces of the springs 32 and 52 to be put on the stationary tube 2 and the remaining elastic force (potential energy) of the spring 32 forces the hook portion 61 of the hook rod 6 to disengage from the upper hook hole 51. Then the outer tube is again loose. The potential energy of the spring 52 is converted into kinetic energy so as to force the inner tube 3 to drop downward and the outer tube 4 falls downward so that the hook portion 61 of the hook rod 6 is again hooked in the lower hook hole 23. The umbrella frame will close, too.

It is clear that the opening or closing of an umbrella frame in accordance with this invention is principally controlled by the pushing rod 24 and the hook rod 25, which are situated in the stationary tube 2. By pushing of the buttons 11 and 12, the outer tube 4 is controlled to rise up or fall down. The springs 32, 52 provide the necessary force to open/close the umbrella frame.

It is noted that the umbrella of this invention is also manually controllable. The upper portion of the hook rod 6, spring 62 thereon, urges the hook portion 61 thereof to withdraw from the hook hole 23 and to push the outer tube 4 upward by hand; or vice versa.

The above examples and description have been given for purposes of illustration, and are not intended to be limitative. Many variations can be effected in the various compositions, methods and processes, without exceeding the scope of the invention.

I claim:

1. A manual/automatic dual-purpose umbrella structure comprising:

a handle (l) having two buttons (11, 12) protruding therefrom and respectively connected with a hook rod (25) and a pushing rod (24);

a stationary tube (2) fixed on a seat of said handle (1); a hook portion (251) of said hook rod (25) and an upper portion of said pushing rod (24) being situated in said stationary tube (2); a pushing block (221) of a leaf spring (22) being supported by said upper portion of said pushing rod (24); a lower hook hole (23) being set on said stationary tube (2) at a corresponding position of said pushing block (221); another leaf spring (21) being set in an upper portion of said stationary tube (2), said leaf spring (21) having a protuberance (211) thereon;

an outer tube (4) having a long recess (42) on one side thereof; a top tube (5) and an inner tube (3) being encompassed by said outer tube (4); a top end of said outer tube (4) having a flange (41) thereon; upper slidable blocks (72), lower slidable blocks (73) and lower fixed blocks (74) being installed on an upper outer portion of said outer tube (4), respectively in order from an uppermost position to a lowermost position; a lower portion of said lower fixed blocks (74) further supporting a hook rod (6);

said inner tube (3) being installed between said top tube (5) and said stationary tube (2) whereon a spring (32) and a pin (31) are provided;

said top tube (5) partially extending from said outer tube (4) and having a long recess (53) and an upper hook hole (51); upper fixed blocks (71) being installed on said top tube (5); and a second spring (52) being set between said upper and lower slidable blocks (72, 73); a passing pin (54) passing through said top tube (5) and being supported by a top of said inner tube (3).

* * * * *